US007758429B2

(12) United States Patent
Crivelli et al.

(10) Patent No.: US 7,758,429 B2
(45) Date of Patent: Jul. 20, 2010

(54) ARTICULATED PLAYER TRACKING PANEL

(75) Inventors: Franco E. Crivelli, Reno, NV (US); Stephen G. Gill, Sparks, NV (US); Matthew D. Cloutier, Reno, NV (US); Mike Garamendi, Reno, NV (US)

(73) Assignee: IGT, Reno, NV (US)

( * ) Notice: Subject to any disclaimer, the term of this patent is extended or adjusted under 35 U.S.C. 154(b) by 1045 days.

(21) Appl. No.: 10/655,510

(22) Filed: Sep. 3, 2003

(65) Prior Publication Data

US 2005/0049043 A1 Mar. 3, 2005

(51) Int. Cl.
*A63F 9/24* (2006.01)

(52) U.S. Cl. ..... 463/46; 463/16; 463/25

(58) Field of Classification Search ..... 463/25, 463/46, 16; 221/123; 361/600
See application file for complete search history.

(56) References Cited

U.S. PATENT DOCUMENTS

| | | | | |
|---|---|---|---|---|
| 4,570,934 | A | 2/1986 | Smyth | |
| 5,813,914 | A * | 9/1998 | McKay et al. | 463/46 |
| 5,996,841 | A | 12/1999 | Marrocco | |
| 6,068,101 | A * | 5/2000 | Dickenson et al. | 194/206 |
| 6,117,010 | A | 9/2000 | Canterbury et al. | |
| 6,533,659 | B2 * | 3/2003 | Seymour et al. | 463/16 |
| 6,688,984 | B2 * | 2/2004 | Cole | 463/46 |
| 6,908,387 | B2 * | 6/2005 | Hedrick et al. | 463/31 |

FOREIGN PATENT DOCUMENTS

| | | | |
|---|---|---|---|
| DE | 3424594 | A1 | 1/1986 |
| DE | 196 17 622 | A1 | 6/1995 |
| EP | 0 071 455 | | 7/1981 |
| EP | 0 316 175 | | 5/1989 |
| EP | 0 897 167 | A2 | 2/1999 |
| EP | 0 989 530 | A2 | 3/2000 |
| EP | 1 143 390 | A2 | 10/2001 |
| GB | 2 265 745 | A | 10/1993 |
| GB | 2 326 505 | A | 12/1998 |

OTHER PUBLICATIONS

"Gaming Machines at Trade Show on Sep. 17, 2002", abstract, p. 1.
No-Bore Concealed Hinges—H-14, Selby Furniture Hardware Company, http://ww.selbyhardware.com/catalog/36.htm, Jan. 3, 2003, p. 2 of 2.
H-Series Hinges, Hafele, p. 1.
Rowe, Richard E., "Cashless Transaction Clearinghouse", U.S. Appl. No. 09/648,382, filed Aug. 25, 2000.
Rowe, Richard E., "Cashless Transaction Clearinghouse", U.S. Appl. No. 10/406,911, filed Apr. 2, 2003.
International Search Report, Int'l Appln. No. PCT/US2004/025934, Applicant's File No. IGT1P091.WO, 4 page document entitled "Articulated Player Tracking Panel".

* cited by examiner

*Primary Examiner*—Peter DunBa Vo
*Assistant Examiner*—Omkar Deodhar
(74) *Attorney, Agent, or Firm*—Weaver Austin Villeneuve & Sampson LLP

(57) ABSTRACT

A gaming machine that includes a player tracking panel configured to fit in a recessed opening of a gaming machine cabinet. The player tracking panel can be attached to the gaming machine cabinet by a hinge in a manner allowing the player tracking panel to be swung away from the gaming machine cabinet to provide access to an interior region of the cabinet through the recessed opening. The player tracking panel can include player tracking devices and associated electronics for processing user interactions with the devices.

29 Claims, 15 Drawing Sheets

ARTICULATED PLAYER TRACKING PANEL

BACKGROUND OF THE INVENTION

I. Field of the Invention

The present invention relates to gaming machines such as traditional slot machines, video slot machines, video poker machines, and video keno machines. More particularly, the present invention relates to a hinged player tracking panel for use with gaming machines.

II. Background

In recent years, player tracking devices have gained in popularity, becoming almost a required accessory of gaming machines in casinos. One reason for this increased demand is that player tracking devices are used to implement loyalty point programs, such as player tracking programs, offered by various casinos. Typically, loyalty point programs provide rewards to players in proportion to the player's level of patronage (e.g., to the player's playing frequency and/or total amount of game plays at a given casino). Loyalty point rewards may be free meals, free lodging and/or free entertainment. These rewards may help to sustain a game player's interest in additional game play during a visit to a gaming establishment and may entice a player to visit a gaming establishment to partake in various gaming activities.

Typically, when a game player wants to play a game on a gaming machine and participate in a player tracking program, a game player inserts a player tracking card, such as a magnetic striped card, into a player tracking device such as a card reader. The card reader may receive certain player identification information from the card, such as a player's name, address, and player tracking account number, which it may relay to a player tracking server that typically stores player tracking account records including the number of player tracking points previously accumulated by a player.

While the card is inserted during game play on the gaming machine, the player tracking unit may poll the gaming machine for game play information such as how much money the player has wagered on each game, the time when each game was initiated and the location of the gaming machine. The game play information is sent by the player tracking unit to the player tracking server and may be used to generate player tracking points and add the points to a player tracking account identified by the player tracking card. The player tracking points generated by the player tracking server are stored in a memory of some type on the player tracking server and/or the player tracking card as part of a loyalty point program.

Player tracking devices, which can include a card reader, a key pad, a display, and the like, are often sold as aftermarket additions to gaming machines by various manufacturers. To accommodate these aftermarket additions, gaming machine manufacturers often provide a region on the gaming machines where the player tracking devices can be installed. This region is typically about three inches in height and located between the main cabinet and the top box on the front of a typical gaming machine. See FIG. 1, as discussed below.

The hardware associated with player tracking devices has become somewhat standardized, both on gaming machines and on the player tracking devices themselves. On the gaming machines, there is typically a player tracking device bracket that spans the three inch high region identified above. This is usually a piece of sheet metal that is attached to the gaming machine with a screw or other attachment mechanism. The player device bracket serves both as a structural member for the gaming machine and a support for a top box glass, which is located within the top box and is typically decorated with graphics or other ornamentation. In addition, the player tracking device bracket serves as a mount for player tracking devices and a player tracking device decorative plate. The player tracking device decorative plate is typically a "snap on" piece or a screw on piece, depending on the manufacturer, that provides access to the user interface portions of the player tracking devices. Behind the player tracking device bracket sits the electronics necessary for the functioning of the player tracking devices.

In order to access the electronics behind this player tracking device bracket, the gaming machine must be substantially dismantled. In particular, because the player tracking device bracket is generally left in place during repair or replacement of player tracking devices, the top box glass must first be removed. Once the top box glass is removed, the electronics behind the bracket can be accessed through the opening created by the removed top box glass. If access below the bracket is desired, a large CRT monitor, mechanical reels, or the like, within the main cabinet of the gaming machine may also need to be removed. Once the CRT monitor, mechanical reels, or the like, is removed, the bottom portions of the electronics can be accessed. The removed top box glass, CRT monitor, mechanical reels, and/or any other parts that are removed must generally be placed on the ground or away from the gaming machine while the machine is serviced.

While the machine is being serviced, the disruption to game play can be costly. In particular, while player tracking devices are being serviced during maintenance, diagnostics, repair, or replacement, the gaming machine is inoperative. In addition, when the gaming machine parts are placed on the floor or around the machine, these parts can take up space on the casino floor and can risk being damaged by passersby. Having parts on the floor can also be unattractive to players and can even be nuisances to players who may injure themselves by tripping over the parts or otherwise becoming entangled with them. The cost of maintenance, along with the loss of playing time and risk of harm to players and gaming machine parts can be expensive for casinos.

Accordingly, there is a need for improved player tracking devices and associated support structures. In particular, these improved designs should allow improved access to the player tracking device electronics and the interior of the gaming machines.

SUMMARY OF THE INVENTION

The techniques of the present invention address the above need by providing a hinged player tracking panel that allows access to player tracking device electronics and the interior region of a gaming machine, without requiring the removal of various gaming machine components.

One aspect of this invention pertains to a gaming machine. Such gaming machine may be characterized by the following features: (a) a gaming machine cabinet having a recessed opening; and (b) a player tracking panel configured to fit in the recessed opening and attached to the gaming machine cabinet by a hinge in a manner allowing the player tracking panel to be swung away from the gaming machine cabinet to provide access to an interior region of the cabinet through the recessed opening, wherein the player tracking panel includes player tracking devices and associated electronics for processing user interactions with the devices.

Another aspect pertains to a gaming machine characterized by the following features: (a) a main cabinet; (b) a top box seated on top of the main cabinet and having top box glass; (c) an opening sized for receiving a player tracking panel; (d) one or more supports, on an upper side of the opening, for supporting the top box glass; and (e) a hinge on one side of the opening configured to attach to a player tracking panel in a manner allowing the player tracking panel to swing between an open position and a closed position, wherein the open position allows access to the gaming machine via the opening, and wherein the closed position blocks the opening.

Yet another aspect pertains to a player tracking assembly. Such player tracking assembly may be characterized by the following features: a panel configured to accommodate a player tracking device; a hinge coupled to the panel, wherein the hinge is configured to join the panel and the gaming machine, wherein the hinge allows access to interior components of a player tracking device mounted to the panel when the panel is pivoted about the hinge into an open position, and wherein the hinge is configured to provide access to the interior components of the player tracking device without the removal of other gaming machine components; and a means for securing the panel in a closed position.

These and other features and advantages of the present invention will be described in more detail below with reference to the associated figures.

DETAILED DESCRIPTION OF INVENTION

Figure 1:
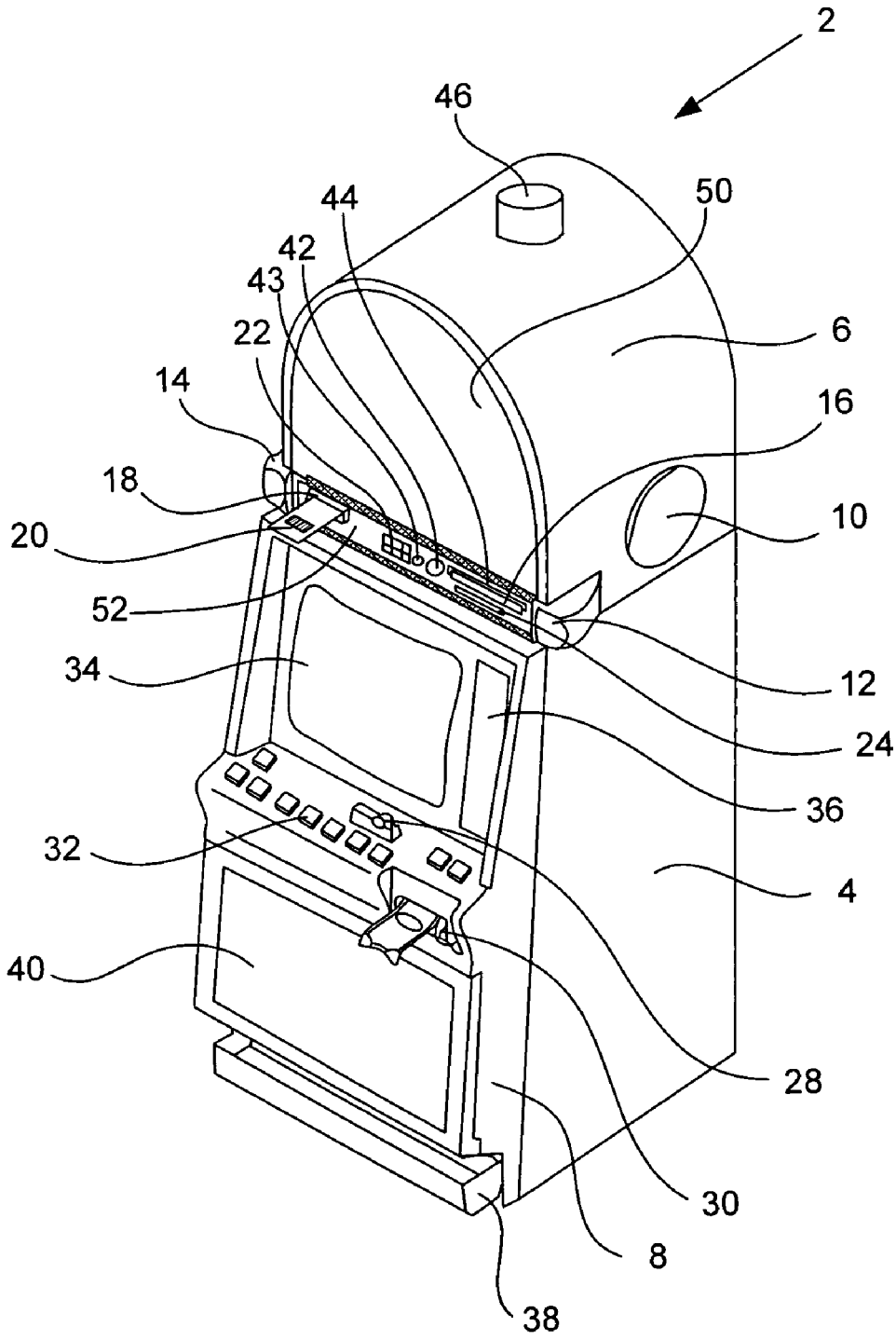
FIG. 1 is a diagrammatic representation of a gaming machine.

The present invention generally relates to a hinged player tracking panel that allows access to player tracking device electronics and the interior region of a gaming machine, without the removal of the player tracking panel and/or top box glass from the gaming machine. With reference to FIG. 1, shown is a diagrammatic representation of one exemplary embodiment of a video gaming machine that can be used with the present invention. Machine 2 includes a main cabinet 4, which generally surrounds the machine interior (not shown) and is viewable by users. Main cabinet 4 includes a main door 8 on the front of the machine, which opens to provide access to the interior of the machine. Attached to the main door are player-input switches or buttons 32, a coin acceptor 28, a bill validator 30, a coin tray 38, and a belly glass 40. Viewable through the main door is a video display monitor 34 and an information panel 36. The display monitor 34 can be a cathode ray tube, high resolution flat-panel LCD, or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. These devices are controlled by circuitry housed inside the main cabinet 4 of the machine 2. Many possible games, including mechanical slot games, video slot games, video poker, video black jack, video pachinko, video bingo, video keno, video card games, lottery, and other games of chance may be presented with the gaming machines and player tracking panels of this invention.

The gaming machine 2 includes a top box 6, which sits on top of the main cabinet 4. The top box 6 houses a number of devices, which may be used to add features to a game being played on the gaming machine 2. In particular, top box 6 can include features such as a top box glass 50 and a lighted candle 46 that may be used for signaling purposes such as to get the attention of various casino personnel. Top box glass 50 can include ornamentation such as graphics, logos, patterns, borders, or the like, which may be applied by a process such as silkscreening, etching, frosting, painting, dying, or the like.

Figure 3:
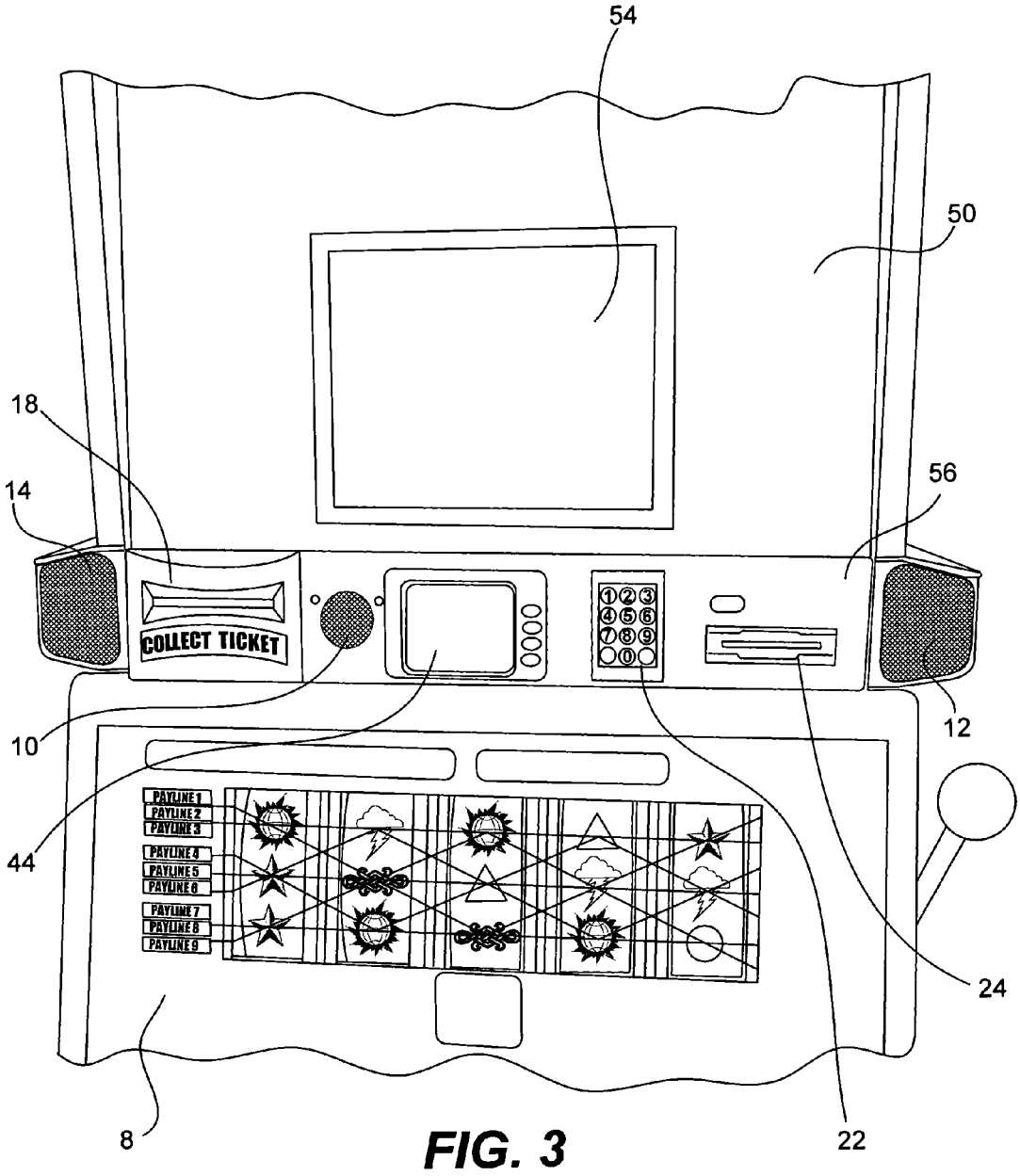
FIG. 3 depicts an exemplary embodiment of a gaming machine having a player tracking panel in a closed position.

A region located at the base of top box 6, can include devices such as speakers 10, 12, 14, a ticket printer 18 which prints bar-coded tickets 20 and may be part of a cashless ticketing system, a key pad 22 for entering player tracking information such as an identification code, a florescent display 16 for displaying player tracking information, a card reader 24 for inserting a magnetic striped card containing player tracking information or other input devices for entering player tracking information, a speaker/microphone for voice commands and voice recognition, biometric input devices such as finger printer for identifying a player, a video display screen 44 for displaying various types of video content such as player tracking information, machine status, bonus games and primary games, and the like. Some of these devices can be mounted to a player tracking panel, as shown in FIG. 3 and described below. The devices that are mounted to the player tracking panel are referred to herein as player tracking devices. Furthermore, as used herein, player tracking panels refer to both 1) panels designed to have player tracking devices mounted to them, even though the player tracking devices may not yet be mounted to the panels, and 2) panels having player tracking devices mounted to them.

Together, the player tracking panel and the mechanisms used to attach the player tracking panel to the gaming machine 2, compose the player tracking assembly, as this term is used herein. More particularly, the player tracking assembly refers to the player tracking panel, including any associated player tracking devices, electronics, and user interface, and attachment mechanisms that can be separated from gaming machine 2 as one unit. As shown, the player tracking assembly fits within a recessed opening in gaming machine 2, such that the front of the player tracking panel can be generally flush with the front surface of the main cabinet 4 or can protrude a desired amount from the front surface of the main cabinet 4.

Although particular features and components are shown in the present embodiment, top box 6 may house different or additional devices than are shown. For example, the top box may contain a bonus wheel or back-lighting for the top box glass 50, which may be used to add bonus features to the game being played on the gaming machine. The back-lighting can include one or more lights that can illuminate various regions of the top box glass 50 that feature various images, awards, and the like. In some embodiments, the top box may also include a display for a progressive jackpot offered on the gaming machine, or other kinds of displays such as a video display screen 54 (FIG. 3) for displaying bonus games, ads, or other gaming machine information or entertainment. During a game, the top box devices are controlled and powered, in part, by circuitry housed within the main cabinet 4 of the gaming machine 2.

It should be recognized that gaming machine 2 is only one exemplary embodiment of a wide range of gaming machine designs on which the present invention may be implemented. For example, some gaming machines have two or more game displays—mechanical and/or video. Also, some gaming machines are designed for bar tables and have displays that face upwards. Those of skill in the art will understand that the present invention, as described below, can be used with most any gaming machine now available or hereafter developed.

In the present embodiment, when a user wishes to play the gaming machine 2, he or she inserts cash or other form of credits through the coin acceptor 28 or bill validator 30. In some embodiments, the bill validator may accept a printed ticket voucher as an indicia of credit when a cashless ticketing system is used. At the start of the game, the player may enter player tracking information using the player tracking devices included in player tracking assembly 52. For instance, the game player's preferences may be read from a card inserted into the card reader 24. During the game, the player can view game information through video display 34. Other game and prize information may also be displayed on the video display screen 44 located in the player tracking assembly or on other display screens included in top box 6.

During the course of a game, a player may be required to make a number of decisions, which affect the outcome of the game using the player-input switches 32, the video display screen 34, or using some other device which enables a player to input information into the gaming machine. For certain game events, the gaming machine 2 may display visual and auditory effects such as various sounds projected by speakers 10, 12, 14 and flashing lights, strobing lights or other patterns displayed from lights on the gaming machine 2 or from lights behind the belly glass 40 or top glass 50, which add to the excitement of a game and encourage the player to continue playing. After the player has completed a game, the player may receive game tokens from the coin tray 38 or a ticket 20 from the printer 18, which may be used for further games or to redeem a prize. The player may also receive a ticket 20 for food, merchandise, or games from the printer 18. In addition, if the player inserted a player tracking card into card reader 24, the player can retrieve the updated player tracking card from card reader 24.

Figure 2:
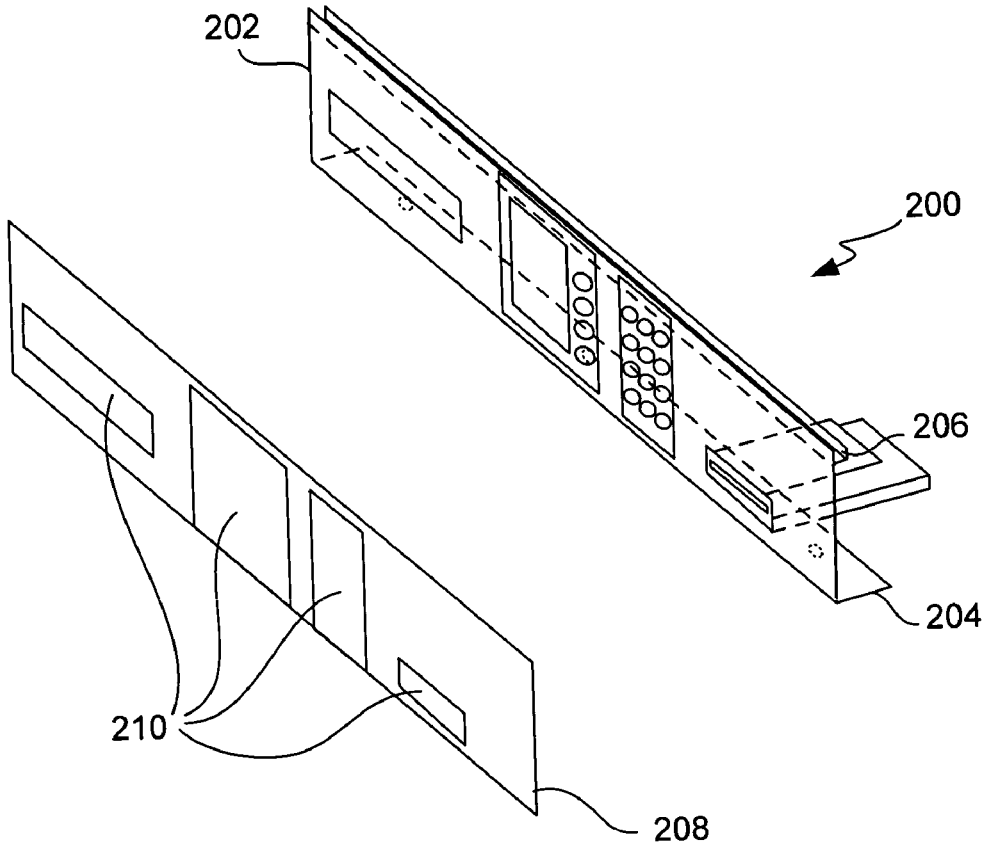
FIG. 2 depicts a traditional player tracking bracket assembly.

With reference to FIG. 2, shown is a traditional player tracking bracket assembly that has been used with various gaming machines, including ones similar to that shown in FIG. 1. Traditional player tracking bracket assembly 200 includes a player tracking device bracket 202 that is typically made of sheet metal, which serves as a structural number for the gaming machine, as well as a mount for a player tracking device decorative plate 208. Bracket 202 can be mounted to a gaming machine cabinet 4 or other portion of a gaming machine 2 (FIG. 1) using flange 204, as described below. Furthermore, bracket 202 can include cut-outs or other openings for player tracking devices. As shown, player tracking bracket assembly includes various player tracking devices that are mounted to the bracket 202 through such openings. Player tracking device bracket 202 also features an integrated top box glass support 206 that typically spans the full width of the top box glass 50. This integrated top box glass support 206 supports top box glass 50 and holds it in place within top box 6.

The decorative plate 208, which can be mounted to bracket 202, can include cut-outs or other openings 210 that provide an interface between players and player tracking devices mounted to bracket 202. Decorative plate 208 can also include ornamentation such as silk-screened graphics, and the like. Typically, decorative plate 208 overlaps the space between player tracking device bracket 202 and other gaming machine components, thereby preventing unauthorized access to the gaming machine such as by the insertion of wires or other devices into this space to pry open or otherwise tamper with gaming machine components.

When the gaming machine 2 (FIG. 1) is assembled, the player tracking device bracket 202 is mounted to the gaming machine cabinet 4 using mounting plate 204, or any other flange. In particular, screws, bolts, welding, soldering, or the like, can be used to attach player tracking device bracket 202 to a gaming machine cabinet 4 (FIG. 1), such that player tracking device bracket 202 can either be removable or non-removable from the gaming machine, depending on the application. For instance, mounting plate 204 can be placed in contact with a top surface of main cabinet 4, and the screws, bolts, or the like, can be used to secure the two surfaces together. After these two surfaces are joined, other aspects of the gaming machine can be assembled, such as a display 34, which can be placed within main cabinet 4 below the top surface of main cabinet 4.

After the gaming machine is assembled, various items must be removed from the gaming machine 2 in order to access the electronics associated with the player tracking devices and the interior components of the gaming machine 2 behind the player tracking device bracket 202. In particular, top box glass 50 (FIG. 1) must be removed to access the top portions of the player tracking device electronics. Additionally, display 34 or any other components beneath the player tracking device bracket 202 must be removed in order to gain access to the bottom portions of the player tracking device electronics. The removed top box glass 50, display 34, and any other parts that are removed must be placed on the ground or away from the gaming machine while the machine is serviced. In some embodiments, mechanical reels, or the like, may be removed in place of or in addition to the display 34.

As described in the Background section above, repairing or replacing the player tracking bracket or gaming machine components behind the player tracking bracket can significantly disrupt game play on the gaming machine. Furthermore, the cost of maintenance, along with the loss of playing time and risk of harm to the players and gaming machine parts can be expensive. Various embodiments of the present invention address these shortcomings by providing a player tracking assembly that allows easier access to the interior of an associated gaming machine and to the player tracking device electronics, without requiring removal of the player tracking assembly. In addition, various embodiments provide a removable player tracking assembly that allows easier removal of the player tracking assembly, thereby facilitating replacement or repair of the player tracking assembly or associated gaming machine devices. Other features that can be included as part of this player tracking assembly can include a separate support for the top box glass 50 and security features such as locking mechanisms to prevent unauthorized access to gaming machine components, and other features that can prevent unauthorized users from defeating the system when the gaming machine is closed and operating.

FIGS. 3-9 depict an exemplary embodiment of a gaming machine with a player tracking assembly. More particularly, these series of figures show progressive views of the gaming machine as the interior of the gaming machine is accessed. With reference to FIG. 3, shown is one exemplary embodiment of a gaming machine having a player tracking panel in a closed position. As described above, player tracking panel 56, along with the mechanisms used to attach the player tracking panel to the gaming machine, compose player tracking assembly 52. In the present embodiment, player tracking panel has various player tracking devices mounted to it, including speaker 10, display screen 44 surrounded by a bezel that includes LED lighting mechanisms and selector buttons, keypad 22, and card reader 24. As shown in the present embodiment, speaker 12, ticket printer 18, and speaker 14 can be located adjacent to player tracking panel 56. As depicted, speakers 12 and 14 can project beyond the general width of the gaming machine 2. In addition, ticket printer 18 can be part of a cashless ticket system, such as IGT's EZ Pay™ cashless system, as described in U.S. patent application Ser. No. 09/648,382, entitled "CASHLESS TRANSACTION CLEARINGHOUSE," by Rowe, filed on Aug. 25, 2000, and U.S. patent application Ser. No. 10/406,911, entitled "CASHLESS TRANSACTION CLEARINGHOUSE," by Rowe, filed on Apr. 2, 2003. The player tracking panel 56 can be about three inches in height and can be recessed within gaming machine 2 such that the front of the player tracking panel 56 is generally flush with the front surface of gaming machine 2, although portions of the player tracking panel may protrude out from this surface, depending on the application.

Figure 4:
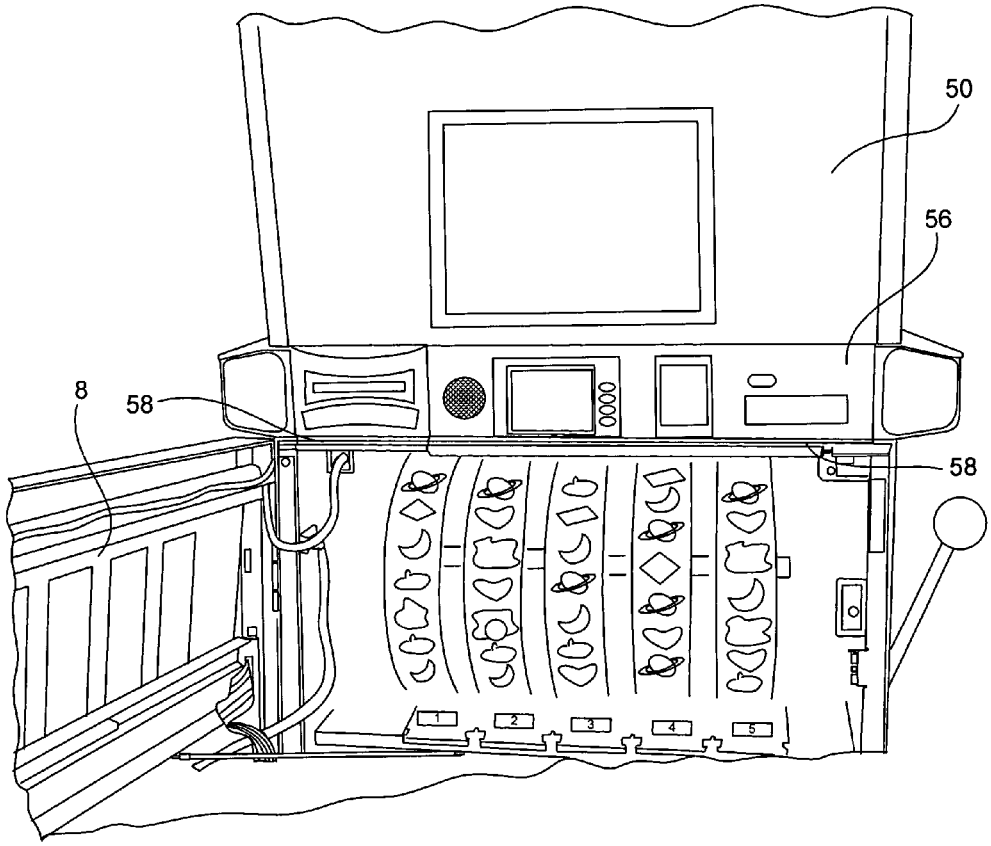
FIG. 4 depicts the exemplary gaming machine with an opened main door.
Figure 5:
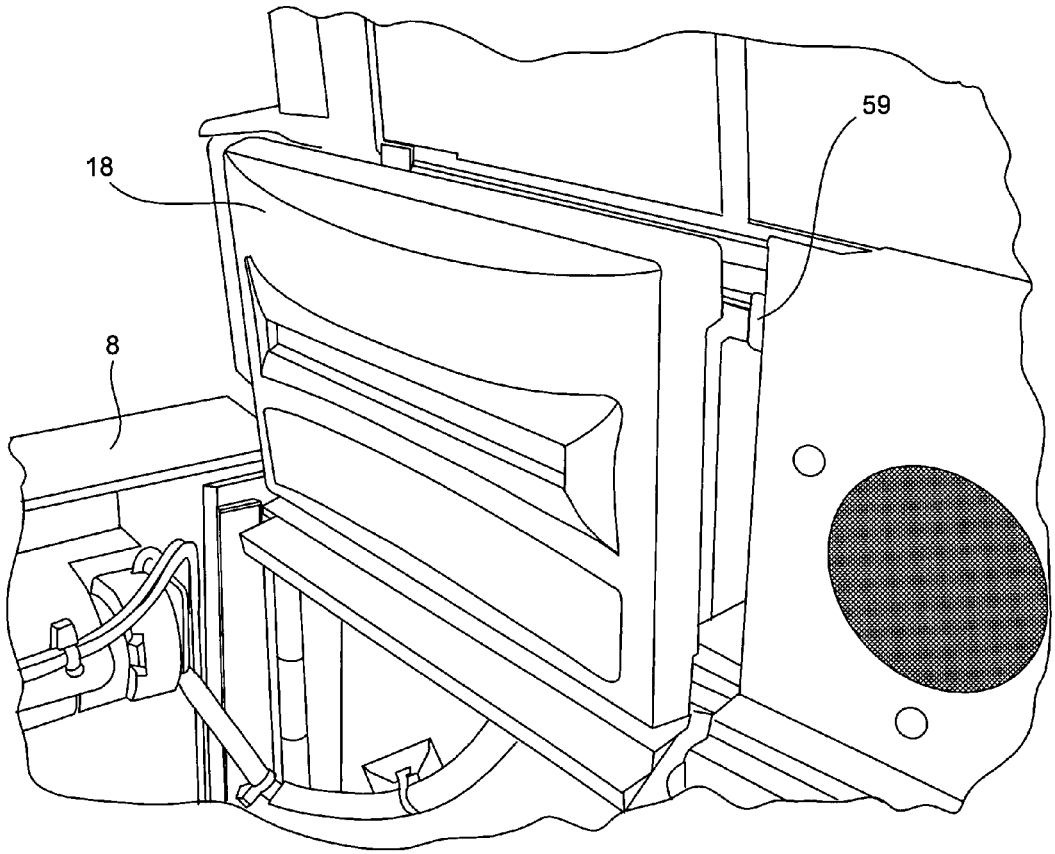
FIG. 5 shows an exemplary ticket printer.

With reference to FIG. 4, the same exemplary gaming machine is shown with main door 8 in an opened position. In the present embodiment, main door 8 closes over a lip portion 58 of the player tracking panel 56 to reduce or eliminate the gap between player tracking panel 56 and main door 8, which can otherwise allow tampering with the gaming machine as described above. In order to access the interior of gaming machine 2 behind player tracking panel 56, main door 8 must first be opened to release lip portion 58. Once main door 8 is opened, ticket printer 18 can be opened, as shown in FIG. 5. Like main door 8, ticket printer 18 closes over a portion 59 of player tracking panel 56 to prevent unauthorized access to the interior of the gaming machine. In the present embodiment, ticket printer 18 can slide forward from the front surface of gaming machine 2 at least far enough for player tracking panel 56 to clear ticket printer 18 when player tracking panel 56 is opened. Once player tracking panel 56 is free from main door 8 and ticket printer 18, player tracking panel 56 can be opened as shown in FIG. 6.

Figure 6:
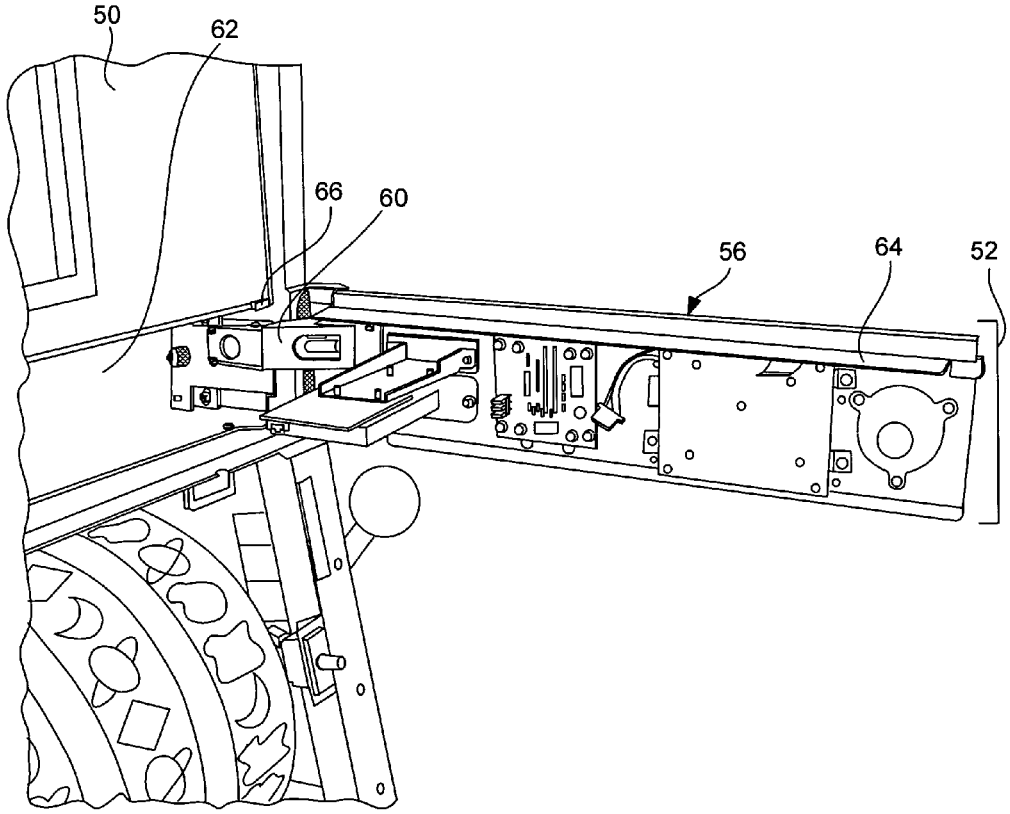
FIG. 6 shows the exemplary gaming machine with an opened player tracking panel.

With reference to FIG. 6, player tracking panel 56 is shown in an opened position. In particular, player tracking panel is swung about hinge 60, which is attached to both main cabinet 4 and player tracking panel 56. As described above, player tracking panel 56 is recessed into gaming machine 2, and speaker 12 (FIG. 3) projects out from the side of gaming machine 2. If a simple hinge were used, speaker 12 would collide with or otherwise obstruct player tracking panel 56 when opened. Furthermore, if player tracking panel 56 were pivoted about a simple hinge, the electronics associated with the player tracking devices closest to the hinge would be difficult to access because they would be located within or near the recessed area 62. Accordingly, hinge 60 allows player tracking panel 56 to be swung open without causing speaker 12 to collide with player tracking panel 56, while also allowing enough room to access the electronics associated with the player tracking devices. One way to allow this type of movement is to use a multilink hinge such as a no-bore concealed hinge, an offset hinge, or a surface mounted concealed hinge, for hinge 60. One type of surface-mounted concealed hinge, model H-2000M, is available from Selby Furniture Hardware Co. Inc., Bronx, N.Y., and an H-Series Hinge is available from Hafele North America Co., Archdale, N.C.

In the present embodiment, hinge 60 is a six bar linkage, having six bars joined by various pins to allow the hinge to move between an opened position and a closed position. Furthermore, hinge 60 can open into a positive locking position where it can remain open at this particular position without external aid. The hinge 60 can be jostled out of this position with a sufficient push or pull. This positive locking position allows service personnel to service the machine or otherwise access the interior 62 of the gaming machine 2 without having to prop open panel 56 or allowing it to swing back and forth. If allowed to swing freely, panel 56 can be inconvenient for the service personnel to handle and can lead to damage of the hinge or other parts of the player tracking assembly. Hinge 60 can also close into a positive locking position where it can remain closed in this particular position without external aid and can be jostled out of this position with a sufficient pull. Although two locking positions are described, any number of locking positions can be used, depending on the application.

In addition to player tracking panel 56, the associated player tracking devices, and hinge 60, player tracking assembly can include a blocking lip 64, which can prevent unauthorized access to the interior of the gaming machine such as when a player attempts to slide a wire or other device through a top gap above player tracking panel 56. Blocking lip 64 can block such foreign objects, thereby protecting the interior components of gaming machine 2. Furthermore, blocking lip 64 can mechanically stiffen player tracking panel 56, thereby protecting the player tracking devices and player tracking assembly 52 from damage that may result if player tracking panel 56 is allowed to bend or sag excessively.

In the present embodiment, one or more glass support brackets 66 can be attached to main cabinet 4 and used to support top box glass 50. As shown, a glass support bracket 66 can also serve as a mount for either hinge 60 or a mounting plate 70 (see FIG. 7 below). By including one or more glass support brackets 66, player tracking panel 56 can be opened without the need to remove top box glass 50. Furthermore, by using hinge 60 to open player tracking panel 56, other components such as a monitor or slot reels do not need to be removed in order to access the electronics associated with the player tracking devices.

Figure 7:
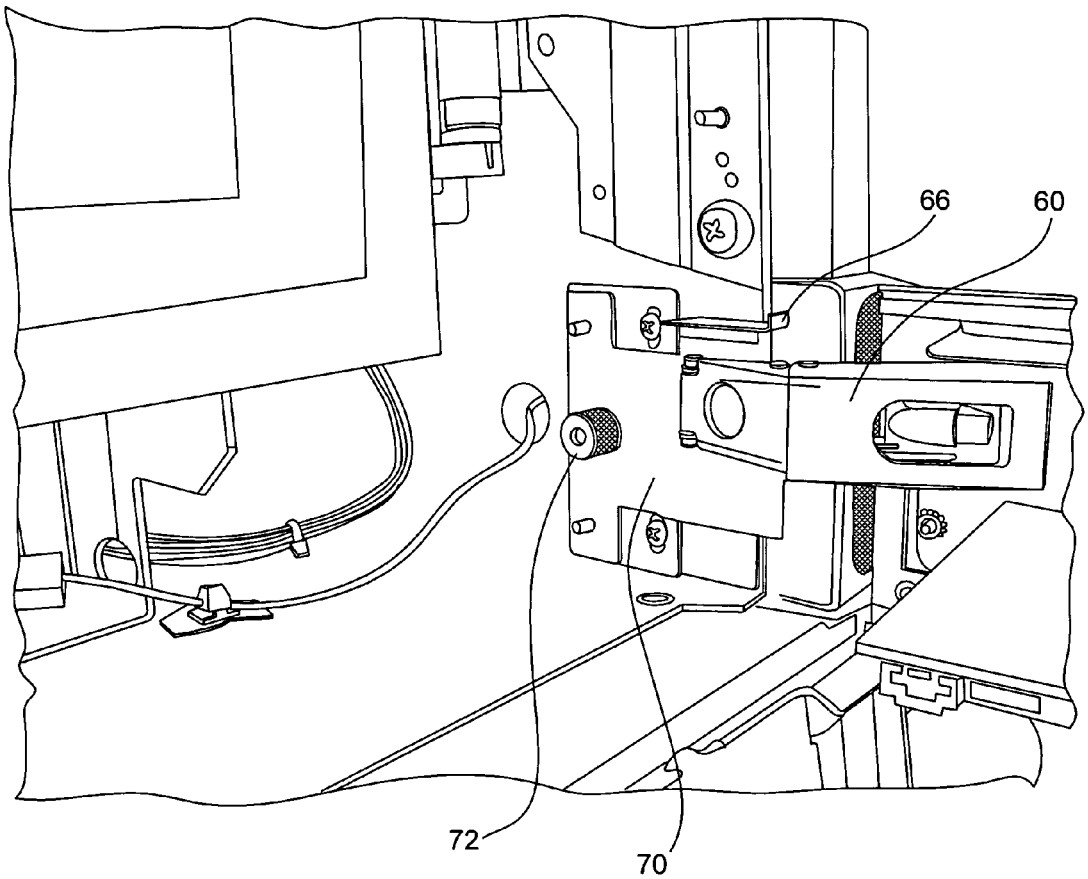
FIG. 7 shows an exemplary hinge and mounting plate.

With reference to FIG. 7, shown is another view of hinge 60 in the present embodiment. Hinge 60 is mounted to mounting plate 70, and mounting plate 70 is mounted to main cabinet 4 with an attachment device 72, such as a pin, thumb nut, wing nut, screw, snap mechanism, captive fastener (as shown), or the like. Any number of attachment devices can be used and they can be placed in any configuration.

Figure 8:
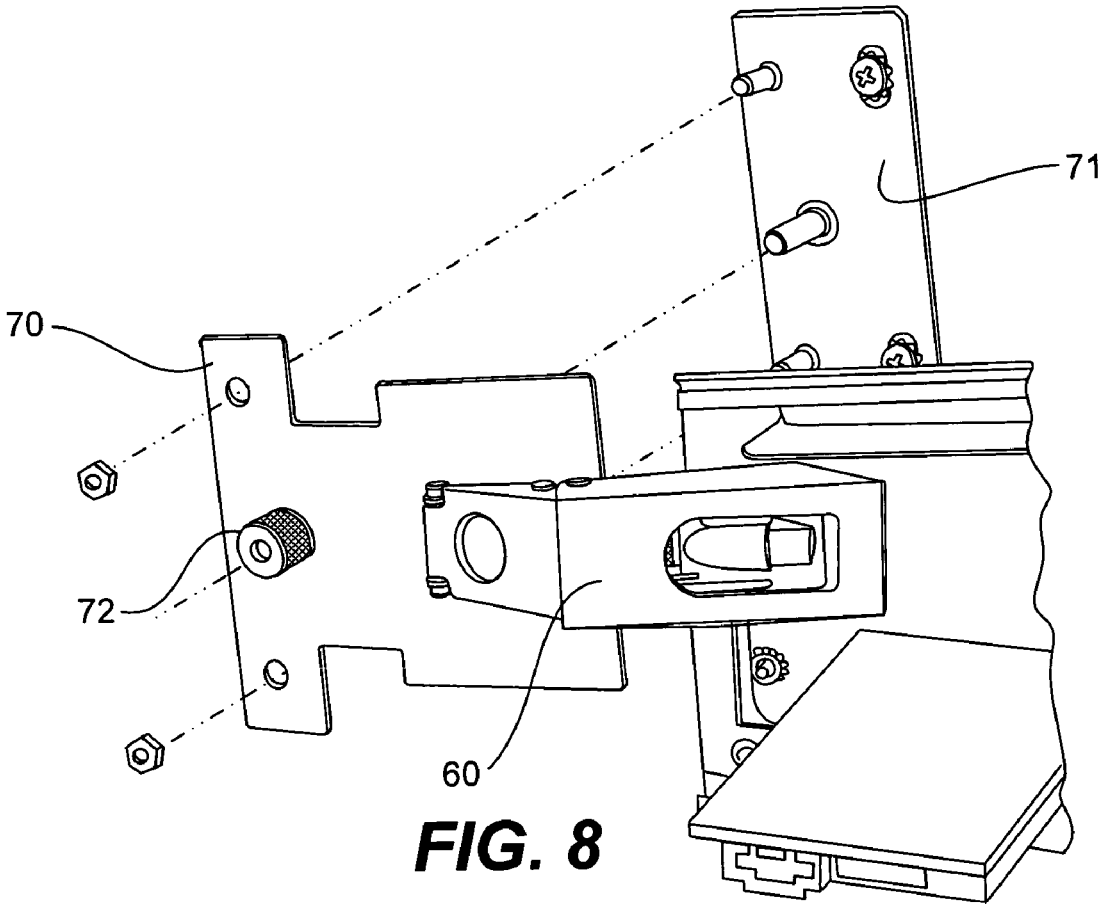
FIG. 8 shows the exemplary removal of a player tracking assembly from a gaming machine cabinet.
Figure 9:
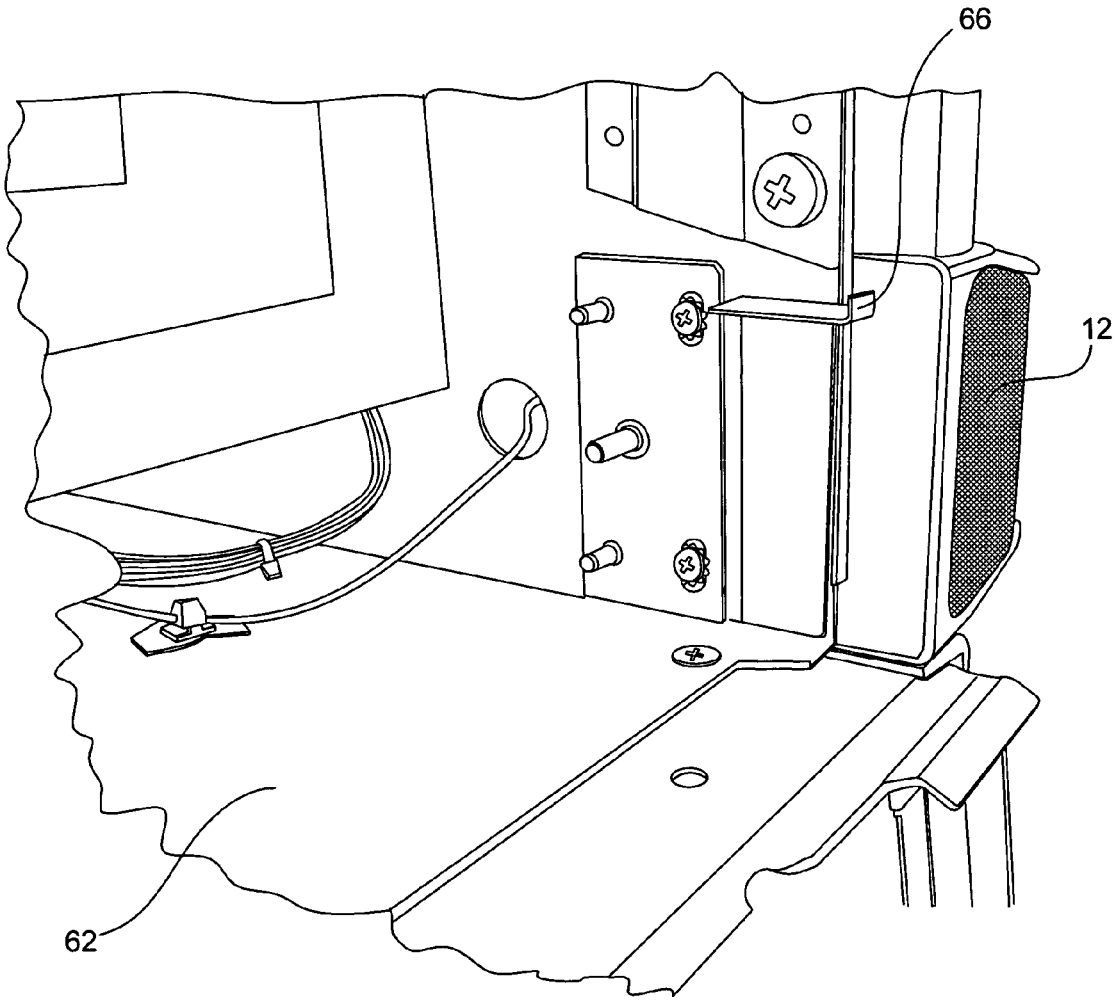
FIG. 9 shows the exemplary gaming machine cabinet with a player tracking assembly removed.

Although interior regions of gaming machine 2 can be accessed by opening player tracking panel 56 without removing it from gaming machine 2, player tracking panel 56 can also be removed from gaming machine 2 to allow repair or replacement of player tracking assembly 52 or any of its associated components. With reference to FIG. 8, shown is a blow apart diagram of a player tracking assembly 52 being removed from main cabinet 4. In particular, attachment device 72 can be removed from mounting plate 70 and main cabinet 4. Next, player tracking assembly 52, which includes hinge 60, mounting plate 70, player tracking panel 56, and its associated player tracking devices, can be removed from gaming machine 2. In other embodiments, player tracking panel 56 may be removed from hinge 60, thereby leaving hinge 60 mounted to main cabinet 4. When replacing a player tracking panel 56 in these embodiments, a substitute player tracking panel 56 can be attached to hinge 60. FIG. 9 shows the same embodiment of gaming machine 2 with player tracking assembly 52 removed. As shown, interior region 62 is exposed and speaker 12 is left in place.

Although the present embodiment includes various exemplary features, it should be recognized that some of the features can be removed or modified within the scope of the present invention. For instance, blocking lip 64 can be removed in some embodiments. In addition, different player tracking devices can be included in player tracking assembly 52, depending on the application. Similarly, other modifications can also be made within the scope of the present invention.

Figure 10:
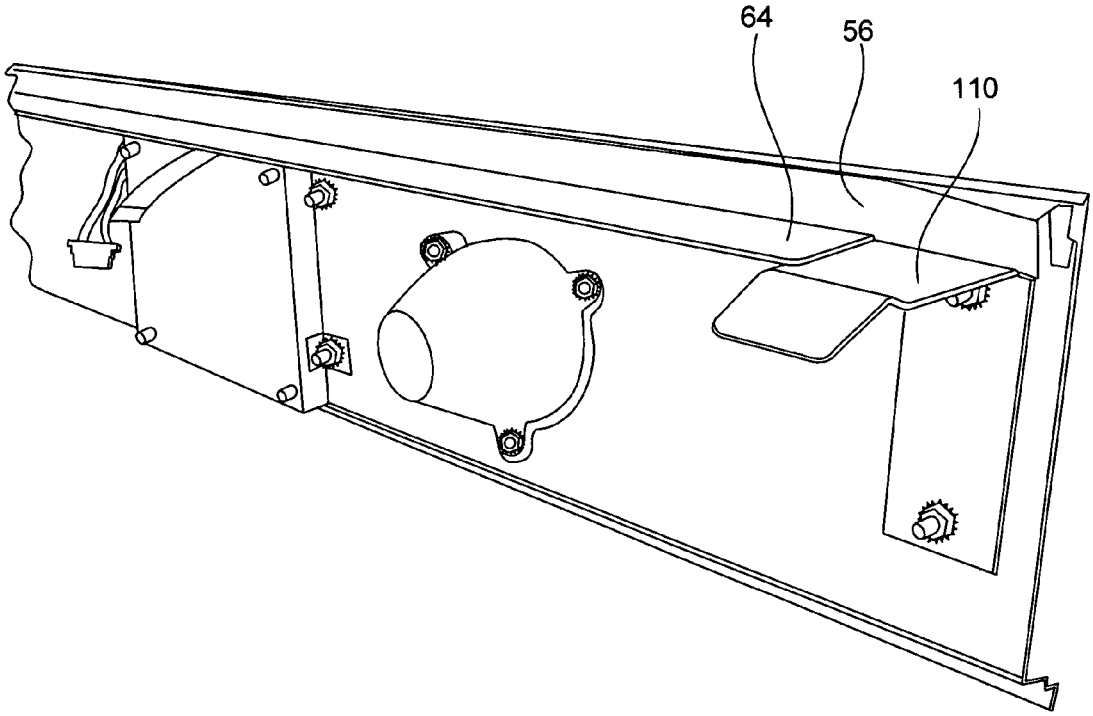
FIG. 10 shows another embodiment of a gaming machine with a player tracking panel in an opened position.
Figure 11:
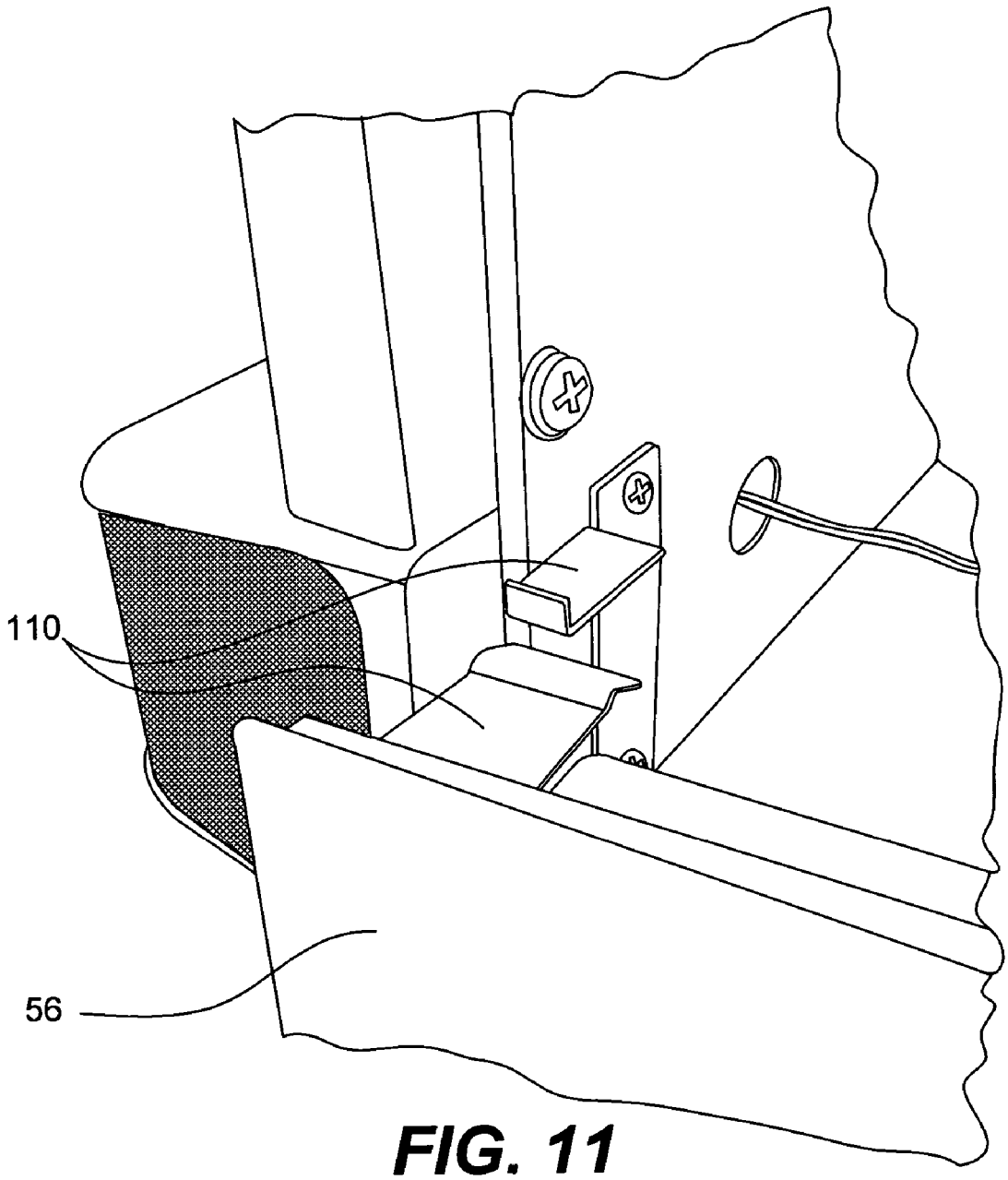
FIG. 11 shows the player tracking panel being moved into a closed position and secured in place with a locking mechanism.
Figure 12:
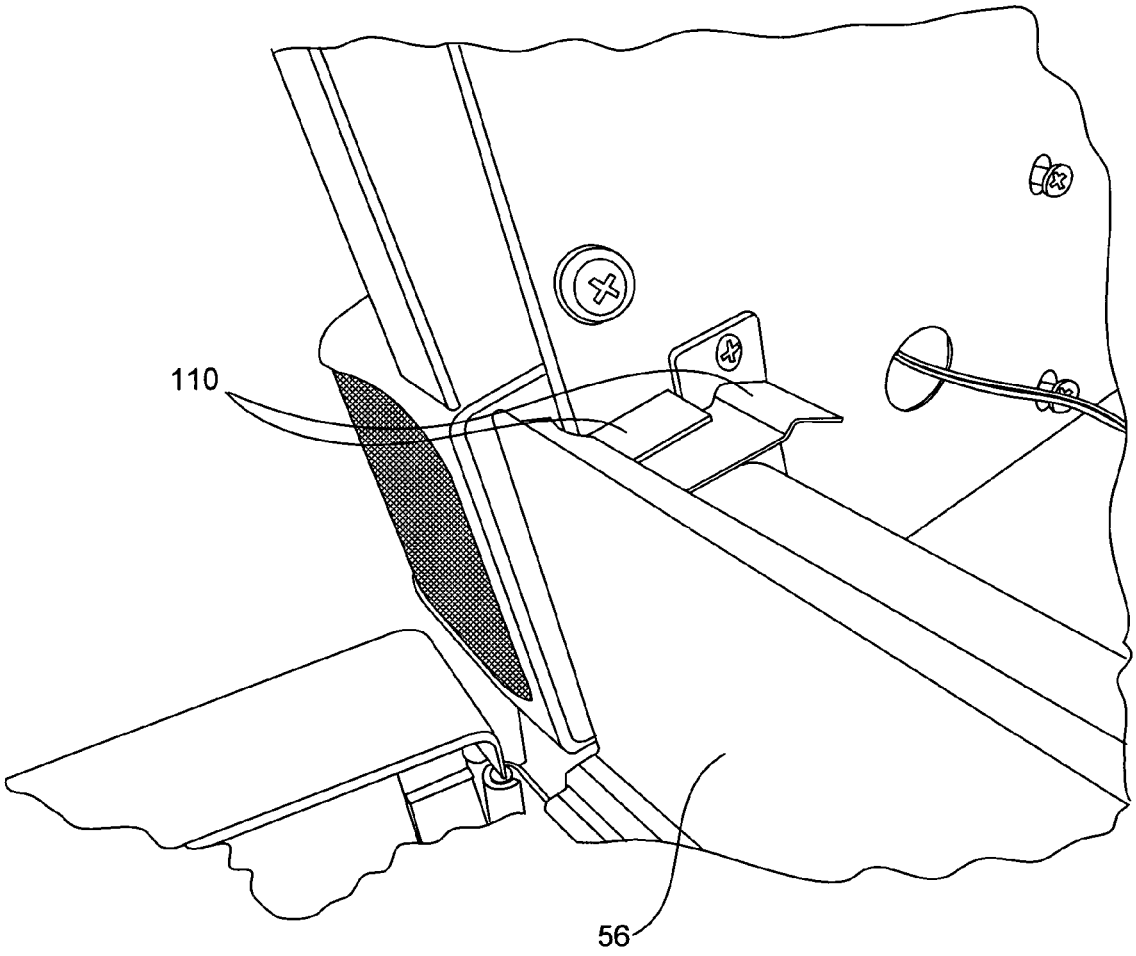
FIG. 12 shows the player tracking panel in a closed and locked position.

FIGS. 10-12 depict an alternative embodiment of a gaming machine with a player tracking assembly. With reference to FIG. 10, player tracking panel 56 is shown in an opened position. The present embodiment is shown without ticket printer 18, although ticket printer 18 can be included depending on the application. This alternative embodiment is similar to the one shown in FIGS. 3-9, except that the present embodiment includes a locking mechanism 110. Locking mechanism 110 can prevent unauthorized access to the interior 62 of the gaming machine 2 by securing the player tracking panel 56 to the main cabinet 4 when the player tracking panel 56 is in a closed position. More particularly, locking mechanism 110 can make it difficult to pry or otherwise open the player tracking panel 56. Any number of locking mechanisms can be included and placed in any position, depending on the application. Furthermore, any type of locking mechanism 110 can be used such as a latch that snaps closed, a pin that joins a portion of the player tracking panel, such as the blocking lip 604, to the gaming machine 2, or the like. With reference to FIG. 11, shown is a depiction of player tracking panel 56 approaching a closed position. The exemplary locking mechanism 110 shown in the present embodiment includes two mating pieces that latch together when the player tracking panel 56 is closed. The mating piece attached to the gaming machine cabinet in the present embodiment can also serve as a glass support 66. With reference to FIG. 12, shown is a depiction of player tracking panel 56 in a closed position. The mating pieces of locking mechanism 110 are engaged, thereby preventing player tracking panel 56 from falling open. In the present embodiment, the locking mechanism 110 can be released by pulling the player tracking panel 56 forward into an opened position. Because locking mechanism 110 can be released by applying enough force when pulling the player tracking panel 56 forward into an opened position, the top box glass 50 can remain in place when the player tracking panel is opened and closed, and when player tracking devices are accessed via player tracking panel 56. In the present FIG. 12, the top box glass 50 is shown removed for clarity purposes only. As described above, the glass support brackets 66 can hold the top box glass 50 in place, independently of player tracking panel 56.

Figure 13:
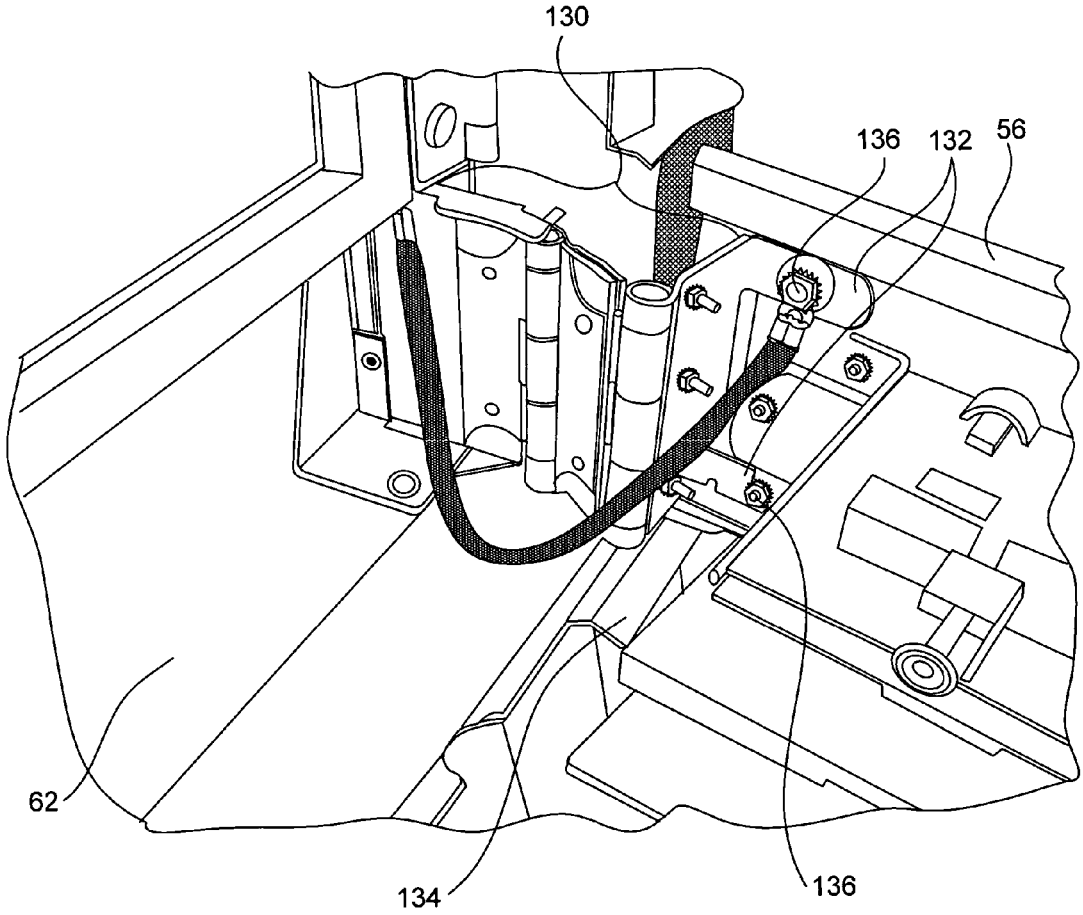
FIG. 13 shows yet another exemplary embodiment of a player tracking panel and a hinge.
Figure 14:
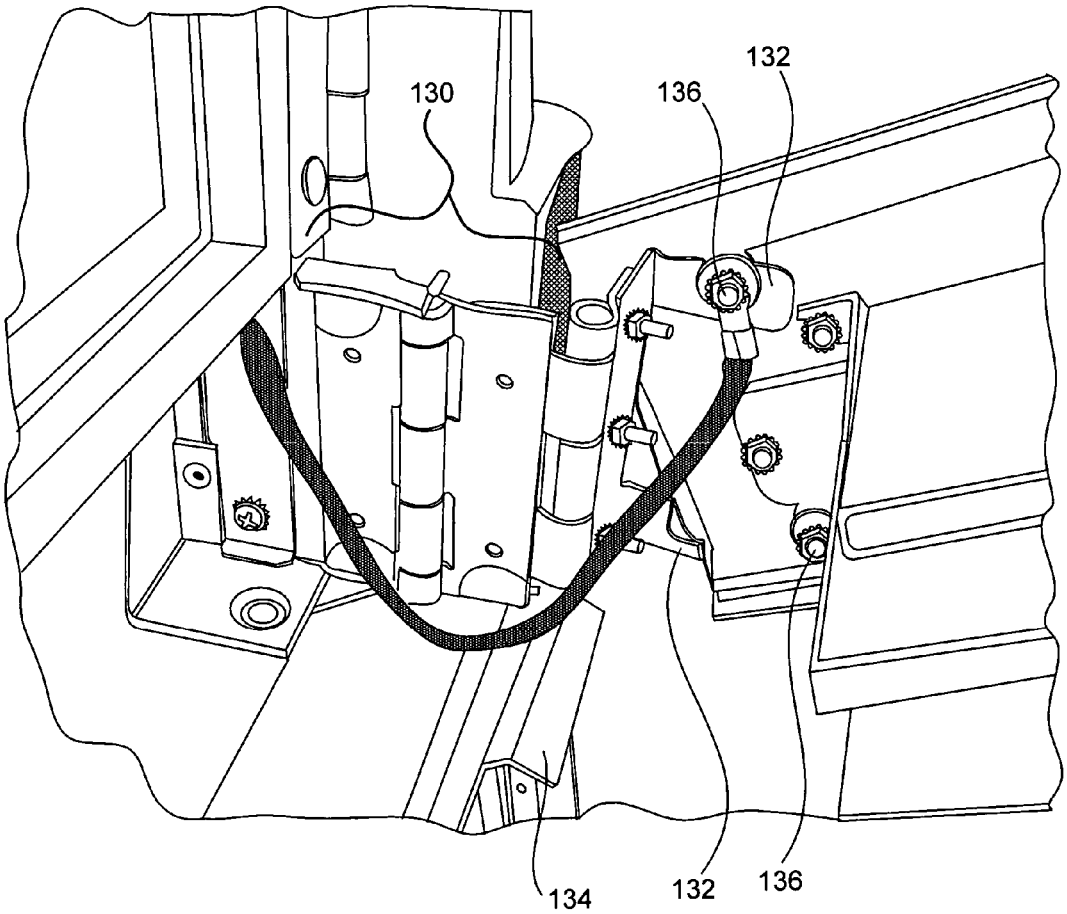
FIG. 14 shows the player tracking panel being removed from the hinge.
Figure 15:
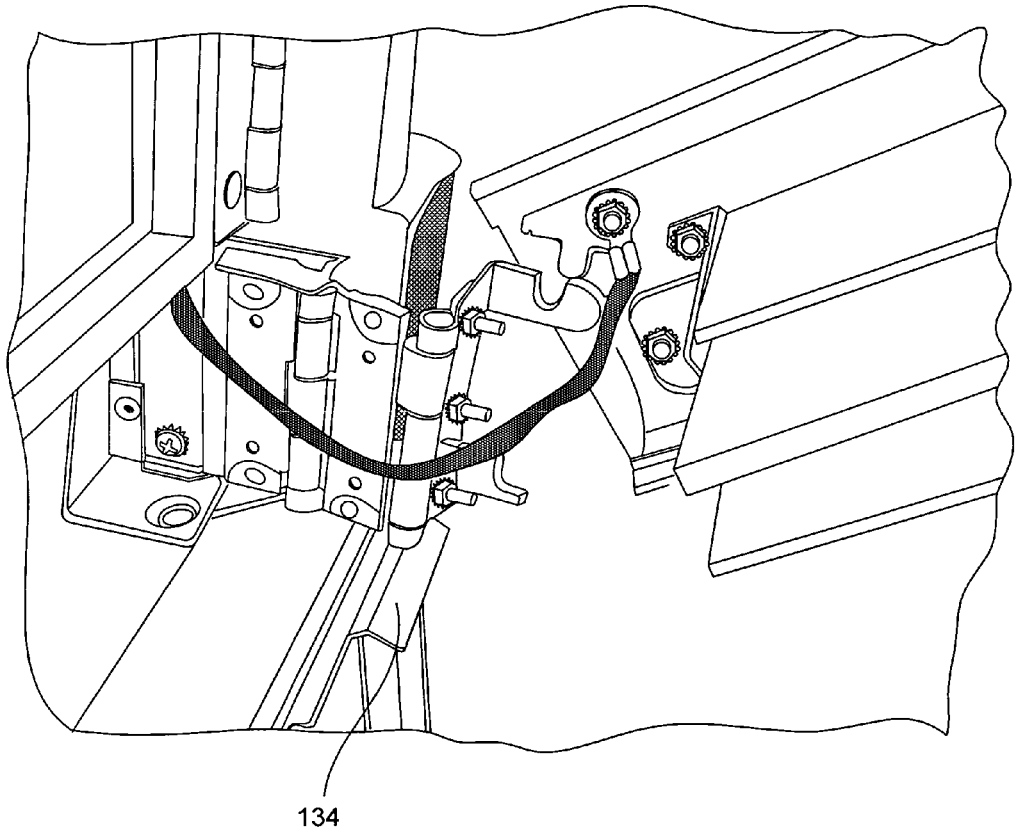
FIG. 15 shows the player tracking panel removed from the hinge.

FIGS. 13-15 depict another alternative embodiment of a gaming machine with a player tracking assembly. With reference to FIG. 13, player tracking panel 56 is shown in an opened position. This alternative embodiment is similar to the ones shown in FIGS. 3-12, except that the present embodiment includes a double hinge 130 that is detachable from player tracking panel 56, and a ramp 134 that can be used to align player tracking panel 56 into its closed position. Double hinge 130 is removably attached to player tracking panel 56 with brackets 132 and bracket pins 136. Bracket pins 136 can be pins, screws, and the like, that can be engaged with brackets 132 when player tracking panel 56 is attached to gaming machine 2 and can be removed from brackets 132 when player tracking panel 56 is removed from gaming machine 2.

With reference to FIG. 14, the same embodiment is shown in which player tracking panel 56 is being removed from hinge 130 and gaming machine 2. As shown, player tracking panel 56 is pivoted upward while in its opened position such that the bottom bracket pin 136 slides away from the bottom bracket 132 and the top bracket pin 136 rotates within top bracket 132. Next, as shown in FIG. 15, player tracking panel 56 is lifted upward such that top bracket pin 136 moves up and out of top bracket 132. After player tracking panel 56 is removed from gaming machine 2, hinge 130 remains attached to gaming machine 2.

As mentioned above, the present embodiment also includes ramp 134. When player tracking devices are mounted to player tracking panel 56, player tracking panel 56 can sag downward when in its opened position such that player tracking panel 56 falls out of alignment and fails to match up with recessed opening 62 as it is swung toward its closed position. Consequently, mating parts of locking mechanisms 110 and other features may not be aligned with each other as player tracking panel is closed. This misalignment can eventually cause the player tracking assembly to become warped or otherwise damaged. Furthermore, this misalignment can be cumbersome, thereby requiring manual alignment each time the player tracking panel 56 is closed. Ramp 134 can be used to address these problems. In particular, ramp 134 can be used to guide player tracking panel 56 from an opened position into a closed position by allowing a bottom portion of player tracking panel 56 to slide up the ramp into its proper position. As shown, ramp 134 can be placed close to hinge 130, such that the width of the ramp need not span the width of the player tracking panel 56 in order to align the player tracking panel. However, any number and size of ramps 134 can be used. Furthermore, other features can be added to address this problem, such as including two or more hinges 130 or 60 placed below and above each other in order to stiffen the connection between hinge 130 or 60 with main cabinet 4 and reduce the amount of "play" in the hinge when the player tracking panel 56 is opened.

Various embodiments of the present invention provide a hinged player tracking panel that allows access to player tracking device electronics and the interior region of a gaming machine, without requiring that the top box glass, player tracking panel, or player tracking assembly be removed from the gaming machine. At the same time, these various embodiments allow for easier removal of the player tracking panel or assembly from the gaming machine if repair or replacement is necessary. These embodiments allow the player tracking panel and/or assembly to be serviced or removed without significant disruption to the gaming machine or expense to the casino. In some cases, a player may continue playing after only a very short interruption by service personnel who examine and/or replace the player tracking panel or assembly.

Although the above generally describes the present invention according to specific exemplary processes and apparatus, various modifications can be made without departing from the spirit and/or scope of the present invention. For instance, although the various exemplary embodiments are described with an upright gaming machine, they can be used with slant top or other gaming machines. Therefore, the present invention should not be construed as being limited to the specific forms shown in the appended figures and described above.

What is claimed is:

1. A gaming machine comprising:

(a) a gaming machine cabinet including a main door, the gaming machine cabinet having an elongated, substantially horizontal, recessed opening;

(b) a top box situated on top of the gaming machine cabinet; and (c) a player tracking panel having a horizontal width and a vertical length, the player tracking panel fitting in the recessed opening and attached to the gaming machine cabinet by a hinge at one end in a manner allowing the player tracking panel to be swung away from the gaming machine cabinet, about a generally vertical rotational axis, to provide access to an interior region of the cabinet through the recessed opening, the player tracking panel including player tracking devices distributed along the horizontal width of the panel and associated electronics mounted thereto for processing user interactions with the devices such that the player tracking devices and associated electronics remain operationally mounted to the panel while being swung away from the gaming machine cabinet, such that the player tracking devices and associated electronics are directly exposed on a rear side of the player tracking panel when the player tracking panel is swung away from the gaming machine cabinet.

2. The gaming machine of claim 1, wherein the devices are chosen from the group consisting of a card reader, a key pad, a display, a ticket printer, a microphone, a biometric input device, and a speaker.

3. The gaming machine of claim 1, wherein said associated electronics are configured to transmit inputs from at least one of the player tracking devices to a player tracking server.

4. The gaming machine of claim 1, wherein the player tracking devices have front surfaces, and wherein the player tracking panel is recessed within the cabinet such that the front surfaces of the player tracking devices are generally flush with a front surface of the cabinet.

5. The gaming machine of claim 4, wherein the hinge is a multilink hinge allowing the player tracking panel to be swung away from the gaming machine without causing collision or obstruction by the player tracking interface and associated electronics with the gaming machine cabinet.

6. The gaming machine of claim 5, wherein the multilink hinge is chosen from the group consisting of a no-bore concealed hinge, a multi-bar linkage, an offset hinge, a surface mounted concealed hinge, and a double hinge.

7. The gaming machine of claim 1, wherein the hinge is locks into each of an open position and a closed position.

8. The gaming machine of claim 1, wherein the player tracking panel is removable from the gaming machine cabinet.

9. The gaming machine of claim 8, wherein the player tracking panel is removable by releasing the hinge from the gaming machine cabinet, wherein the hinge is coupled to the gaming machine cabinet by a pin, thumbnut, or snap mechanism, and wherein the hinge remains coupled to the player tracking panel after the hinge is released from the gaming machine cabinet.

10. The gaming machine of claim 8, wherein the player tracking panel is removable from the hinge.

11. The gaming machine of claim 1, wherein the player tracking panel further comprises a locking mechanism configured to prevent unauthorized access to the interior of the gaming machine by securing the player tracking panel to the gaming machine cabinet or the top box.

12. The gaming machine of claim 1, wherein the main door closes over a portion of the player tracking panel to prevent unauthorized access to the interior of the gaming machine.

13. The gaming machine of claim 1, further comprising a ticket printer that closes over a portion of the player tracking panel to prevent unauthorized access to the interior of the gaming machine.

14. The gaming machine of claim 1, wherein the player tracking panel further comprises a blocking lip configured to prevent unauthorized access to the interior of the gaming machine.

15. The gaming machine of claim 14, wherein the blocking lip mechanically stiffens the player tracking panel.

16. The gaming machine of claim 1, further comprising a glass support bracket supporting a top box glass without support from the player tracking panel.

17. The gaming machine of claim 16, wherein the top box glass remains supported in place by the glass support bracket when the player tracking panel is swung away from the gaming machine cabinet.

18. The gaming machine of claim 1, further comprising a ramp device guiding the player tracking panel from an open position to a closed position.

19. The gaming machine of claim 1, wherein the player tracking panel has a height of about three inches.

20. The gaming machine of claim 1, wherein the player tracking panel further includes:

a communications interface transmitting game play information received by the player tracking devices to a server over a network.

21. A gaming machine comprising:

(a) a main cabinet including a main door;

(b) a top box seated on top of the main cabinet and having top box glass;

(c) an elongated player tracking panel having a horizontal width and a vertical length, the player tracking panel disposed in an elongated, substantially horizontal, recessed opening sized for receiving thereof, said player tracking panel containing player tracking devices distributed along the horizontal width of the panel and associated electronics mounted thereto for processing user interactions with the devices;

(d) one or more supports, on an upper side of the opening, for supporting the top box glass; and (e) a hinge on one side of the opening attaching to a player tracking panel in a manner allowing the player tracking panel to swing between an open position and a closed position, about a generally vertical rotational axis, wherein the open position allows access to the gaming machine via the opening, and wherein the closed position blocks the opening, such that the player tracking devices and associated electronics are directly exposed on a rear side of the player tracking panel when the player tracking panel is swung away from the gaming machine cabinet, and wherein the player tracking devices and associated electronics remain operationally mounted to the panel while being swung away from the gaming machine cabinet.

22. The gaming machine of claim 21, wherein the devices are chosen from the group consisting of a card reader, a key pad, a display, a ticket printer, a microphone, a biometric input device, and a speaker.

23. The gaming machine of claim 21, wherein the hinge is a multilink hinge allowing the player tracking panel to be swung away from the gaming machine without causing collision or obstruction by the player tracking interface and associated electronics with the gaming machine cabinet.

24. The gaming machine of claim 23, wherein the multilink hinge is chosen from the group consisting of a no-bore concealed hinge, a multi-bar linkage, an offset hinge, a surface mounted concealed hinge, and a double hinge.

25. The gaming machine of claim 21, wherein the hinge locks into each of an open position and a closed position.

26. The gaming machine of claim 21, wherein the main door closes over a portion of a player tracking panel when the player tracking panel is coupled to the hinge.

27. The gaming machine of claim 21, further comprising a ticket printer closing over a portion of a player tracking panel when the player tracking panel is coupled to the hinge.

28. The gaming machine of claim 21, further comprising a ramp device guiding a player tracking panel from an open position to a closed position.

29. The gaming machine of claim 21, wherein the top box glass can remain supported by the one or more supports within the top box when the player tracking panel is swung into an open position.

* * * * *